US006364624B1

(12) United States Patent
Popov

(10) Patent No.: US 6,364,624 B1
(45) Date of Patent: Apr. 2, 2002

(54) OPERATION METHOD FOR A PUMPING-EJECTION APPARATUS AND PUMPING-EJECTION APPARATUS FOR REALIZING THIS METHOD

(75) Inventor: Serguei A. Popov, 4615 Post Oak Pl., Suite 255, Houston, TX (US) 77027

(73) Assignees: Evgueni D. Petroukhine, Limassol (CY); Serguei A. Popov, Budapest (HU)

( * ) Notice: Subject to any disclaimer, the term of this patent is extended or adjusted under 35 U.S.C. 154(b) by 0 days.

(21) Appl. No.: 09/530,120

(22) PCT Filed: Aug. 23, 1999

(86) PCT No.: PCT/IB99/01457

§ 371 Date: Apr. 24, 2000

§ 102(e) Date: Apr. 24, 2000

(87) PCT Pub. No.: WO00/11349

PCT Pub. Date: Mar. 2, 2000

(30) Foreign Application Priority Data

Aug. 25, 1998 (RU) ..... 98116295

(51) Int. Cl.[7] ..... F04F 19/24
(52) U.S. Cl. ..... 417/54; 417/53
(58) Field of Search ..... 260/346.4; 423/231; 208/356; 210/696; 203/94; 417/53, 54, 313, 151; 196/114; 261/76

(56) References Cited

U.S. PATENT DOCUMENTS 4,269,776 A * 5/1981 Keunecke et al. ..... 260/346.4
4,528,169 A * 7/1985 La Mori et al. ..... 423/231

(List continued on next page.)

FOREIGN PATENT DOCUMENTS

DE 1050498 8/1959
DE 1092044 11/1960

(List continued on next page.)

*Primary Examiner*—Teresa Walberg
*Assistant Examiner*—Leonid Fastovsky
(74) *Attorney, Agent, or Firm*—Mark A. Oathout

(57) ABSTRACT

An operational method includes evacuating a gaseous medium by a steam-gas ejector, feeding a steam-gas mixture formed in the steam-gas ejector into a counter-flow condenser-separator, feeding a condensing hydrocarbon liquid, whose saturated vapor pressure is lower than the saturated vapor pressure of water into the condenser-separator, condensing steam and easy-condensable components of the evacuated gaseous medium in the condenser-separator by the condensing hydrocarbon liquid, discharging a portion of the steam condensate (water) from the condenser-separator, feeding a mixture of the rest of the steam condensate (water) and the condensate of easy-condensable components of the evacuated gaseous medium into an inlet separator, evacuating non-condensable components of the gaseous medium from the condenser-separator by a first-stage liquid-gas ejector, separating the mixture received in the inlet separator from the condenser-separator into water and condensate of the evacuated gaseous medium, discharging the water from the inlet separator, feeding a liquid mixture of the residuary water and condensate of the evacuated gaseous medium from the inlet separator into a first-stage separator, separating the residuary water from the liquid mixture in the first-stage separator, discharging this water from the first-stage separator, delivering a mixture of the motive liquid and condensate of the evacuated gaseous medium to the suction port of the pump. Also an apparatus is introduced which includes a steam-gas ejector, a counter-flow barometric condenser-separator, an inlet separator, first-stage and second-stage liquid-gas ejectors, first-stage and second-stage separators and a pump. The operational method and related pumping-ejection apparatus provide more effective evacuation of gaseous mediums.

5 Claims, 1 Drawing Sheet

U.S. PATENT DOCUMENTS 4,717,468 A * 1/1988 Funk ..... 208/356
5,656,172 A * 8/1997 Kitz et al. ..... 210/696
5,980,698 A * 11/1999 Abrosimov et al. ..... 203/94
6,086,721 A * 7/2000 Tsegelsky et al. ..... 196/114
6,106,243 A * 8/2000 Popov ..... 417/313
6,109,882 A * 8/2000 Popov ..... 417/53
6,120,254 A * 9/2000 Popov ..... 417/151
6,199,834 B1 * 3/2001 Popov et al. ..... 261/76

FOREIGN PATENT DOCUMENTS

| | | |
|---|---|---|
| EP | 0783910 | 7/1997 |
| RU | 2073123 | 2/1997 |
| SU | 1955 | 11/1926 |
| SU | 1373906 | 2/1988 |

* cited by examiner

OPERATION METHOD FOR A PUMPING-EJECTION APPARATUS AND PUMPING-EJECTION APPARATUS FOR REALIZING THIS METHOD

BACKGROUND OF THE INVENTION

The invention pertains to the field of jet technology, primarily to pump-ejector units for producing a vacuum or evacuation and compression of various gaseous mediums.

An operational process of a pumping-ejection system is known, which includes delivery of a liquid medium into a nozzle of a liquid-gas ejector by a pump, evacuating a gaseous medium by the ejector, discharging a gas-liquid mixture from the ejector into a separator, separating the mixture into the compressed gas and motive liquid, and delivery of the motive liquid from the separator to a suction port of the pump (see application EP 0783910, MPK 6 B 01D3/10, 29.02.96).

This application also introduces a pumping-ejection system having a liquid-gas ejector, a source of an evacuated gaseous medium, a separator and a pump, wherein the gas inlet of the ejector is connected to the source of an evacuated gaseous medium, a nozzle of the ejector is connected to the discharge side of the pump, an outlet of the ejector is connected to the separator, and the liquid outlet of the separator is connected to the suction port of the pump.

The described operational process and system for its embodiment provide evacuation of a gaseous medium entailing minimal environmental pollution. However this process and system do not ensure sufficient compression of the evacuated gas. Therefore application of additional means for compression of gas is required.

The starting point for the present invention is an operational process of a pumping-ejection apparatus, which includes delivering a motive liquid under pressure into the nozzles of first-stage and second-stage liquid-gas ejectors by a pump, evacuating a gas-vapor medium by the first-stage ejector, discharging a gas-liquid mixture composed of the evacuated gas-vapor medium and motive liquid from the first-stage ejector into a first-stage separator, separating the mixture in the first-stage separator into the compressed gas and motive liquid, feeding the motive liquid from the first-stage separator to the pump, evacuating the compressed gas from the first-stage separator by the second-stage ejector, additionally compressing the gas and mixing it with the motive liquid in the second-stage ejector, discharging the so formed gas-liquid mixture from the second-stage ejector into a second-stage separator, separating the mixture received from the second-stage ejector in the second-stage separator into the additionally compressed gas and motive liquid, delivering the additionally compressed gas from the second-stage separator to consumers, delivering the motive liquid from the second-stage separator into the first-stage separator (see Certificate of authorship USSR 1535114, MPK 6 F 04 F 5/48, 29.09.86).

The same USSR Certificate of authorship No. 1535114 describes a pumping-ejection apparatus having a first-stage ejector and a first-stage separator, a second-stage ejector and a second-stage separator, and a pump. The suction side of the pump is connected to the first-stage separator, the discharge side of the pump is connected to the nozzles of the first-stage and second-stage ejectors, outlets of the first-stage and second-stage ejectors are connected to the first-stage and second-stage separators, respectively, the second-stage separator is connected to the first-stage separator, the gas inlet of the second-stage ejector is connected to the first-stage separator.

This pumping-ejection apparatus provides two-stage compression of an evacuated gaseous medium. However while evacuating a multi-component gaseous medium—the mixture of hydrocarbon gases and water steam, for example—the motive liquid accumulates admixtures. This changes physicochemical properties of the motive liquid and negatively affects the capacity of the liquid-gas ejectors.

SUMMARY OF THE INVENTION

This invention is aimed at more effective evacuation of a gaseous medium by providing separation of condensable components of the evacuated gaseous medium and by creating optimal operating conditions for pumping equipment of the pumping-ejection apparatus.

The stated objectives are achieved with the use of an operational process of a pumping-ejection apparatus, which includes delivery of a motive liquid under pressure into the nozzles of first-stage and second-stage liquid-gas ejectors by a pump, evacuating a gas-vapor medium by the first-stage ejector, discharging a gas-liquid mixture composed of the evacuated gas-vapor medium and motive liquid from the first-stage ejector into a first-stage separator, separating the mixture in the first-stage separator into the compressed gas and motive liquid, feeding the motive liquid from the first-stage separator to the pump, evacuating the compressed gas from the first-stage separator by the second-stage ejector, additionally compressing the gas and mixing it with the motive liquid in the second-stage ejector, discharging the so formed gas-liquid mixture from the second-stage ejector into a second-stage separator, separating the mixture in the second-stage separator into the additionally compressed gas and motive liquid, delivering the additionally compressed gas from the second-stage separator to consumers, delivering the motive liquid from the second-stage separator into the first-stage separator, and which is modified so that the gaseous medium is evacuated first by a steam-gas ejector, a steam-gas mixture formed in the steam-gas ejector is fed into a counter-flow condenser-separator, simultaneously a condensing hydrocarbon liquid, whose saturated vapor pressure is lower than the saturated vapor pressure of water, is fed into the condenser-separator, the condensing liquid condenses water steam and easy-condensable components of the evacuated gaseous medium while flowing through the condenser-separator, a portion of the steam condensate (water) is discharged from the condenser-separator, a liquid mixture composed of the rest of the steam condensate and the condensate of the easy-condensable components of the evacuated gaseous medium is delivered to an inlet separator, non-condensable components of the steam-gas mixture are evacuated from the condenser-separator by the first-stage liquid-gas ejector, the liquid mixture is separated in the inlet separator into water and the condensate of the evacuated gaseous medium, the water is discharged from the inlet separator, the condensate of the evacuated gaseous medium is delivered from the inlet separator to the first-stage separator, in the first-stage separator the remaining water is separated from the mixture of mediums and then is discharged from this separator, and a mixture composed of the motive liquid and condensate of the evacuated gaseous medium is delivered to the suction port of the pump.

With regard to the apparatus as the subject-matter of the invention, the mentioned technical problem is solved as follows:

- a pumping-ejection apparatus, which has a first-stage ejector, a first-stage separator, a second-stage ejector, a second-stage separator and a pump, and wherein the suction side of the pump is connected to the first-stage separator, the discharge side of the pump is connected to the nozzles of the first-stage and second-stage ejectors, outlets of the first-stage and second-stage ejectors are connected to the first-stage and second-stage separators, respectively, the second-stage separator, is connected to the first-stage separator, the gas inlet of the second-stage ejector is connected to the first-stage separator, is furnished further with a steam-gas ejector, a counter-flow barometric condenser-separator and an inlet separator. A nozzle of the steam-gas ejector is connected to a source of compressed steam, the gas inlet of the steam-gas ejector is connected to a source of an evacuated gaseous medium, an outlet of the steam-gas ejector is connected to the counter-flow condenser-separator, the counter-flow condenser-separator is connected to the gas inlet of the first-stage ejector and to the inlet separator, the counter-flow condenser-separator is furnished with a water discharge manifold and a device for feeding a hydrocarbon condensing liquid, whose saturated vapor pressure is lower than the saturated vapor pressure of water, and the inlet separator is connected to the first-stage separator.

In addition, the pumping-ejection apparatus can be furnished with a jet pump and an additional pump both installed between the first-stage separator and the suction side of the pump. In this case an evacuated medium inlet of the jet pump is connected to the first-stage separator, a nozzle of the jet pump is connected to the discharge side of the additional pump, an outlet of the jet pump is connected to the suction side of the additional pump, the discharge side of the additional pump is connected to the suction side of the pump.

The apparatus can be also furnished with a make-up supply conduit, a water discharge pipeline and an additional jet pump installed between the inlet separator and the first-stage separator. If this is the case, the make-up supply conduit is connected to the nozzle of the jet pump, the water discharge pipeline is connected to the inlet and first-stage separators, a nozzle of the additional jet pump is connected to the discharge side of the additional pump, an evacuated medium inlet of said additional jet pump is connected to the inlet separator, and an outlet of the additional jet pump is connected to the first-stage separator.

And finally, the pumping-ejection apparatus can be furnished with a conduit for discharging a surplus amount of the motive liquid and the device for feeding the hydrocarbon condensing liquid to the condenser-separator can be connected to this discharge conduit.

Research of the processes, which took place during gas evacuation, gas compression and during maintaining a vacuum in an evacuated reservoir, has shown that the combined application of a steam-gas ejector and liquid-gas ejectors ensures a more effective operation of the pumping-ejection apparatus if compared with separate usage of these types of jet devices. Availability of a steam ejector allows separation of water steam and easy-condensable components (easy-condensable hydrocarbon gases, for example) from an evacuated gas straight-on during the initial stage of the process. On the same stage of the process it is possible to arrange discharge of water from the apparatus and delivery of a condensate of the hydrocarbon gases into the loop of motive liquid circulation. Thus several problems are solved at once: a motive liquid is refreshed by a cognate medium, entrainment of the condensate of the hydrocarbon gases by water to a sewerage system is prevented and, as a result, environmental safety of the apparatus is provided. Discharge of a portion of the water constituting steam condensate from the counter-flow condenser-separator makes the operation of the condenser more stable and increases its capacity due to a drop in content of the is steam condensate in the upper section of the condenser. A decreased content of the steam condensate makes boiling-up of the condensate in the zone of reduced pressure of the condenser impossible. As a result, it is possible to reduce consumption of the condensing liquid on the one hand and, on the other hand, to reduce flow resistance of the condenser and to avoid steam "plugs" in it.

Availability of the additional jet pumps and the additional pump provides a wider range for adjustment of pressures in the separators and, at the same time, ensures transfer of the motive liquid between the separators. As a result, the pumping-ejection apparatus becomes more reliable.

Thus, the described pumping-ejection apparatus implementing the introduced method provides more effective and reliable evacuation of gaseous mediums.

DETAILED DESCRIPTION

Figure 1:
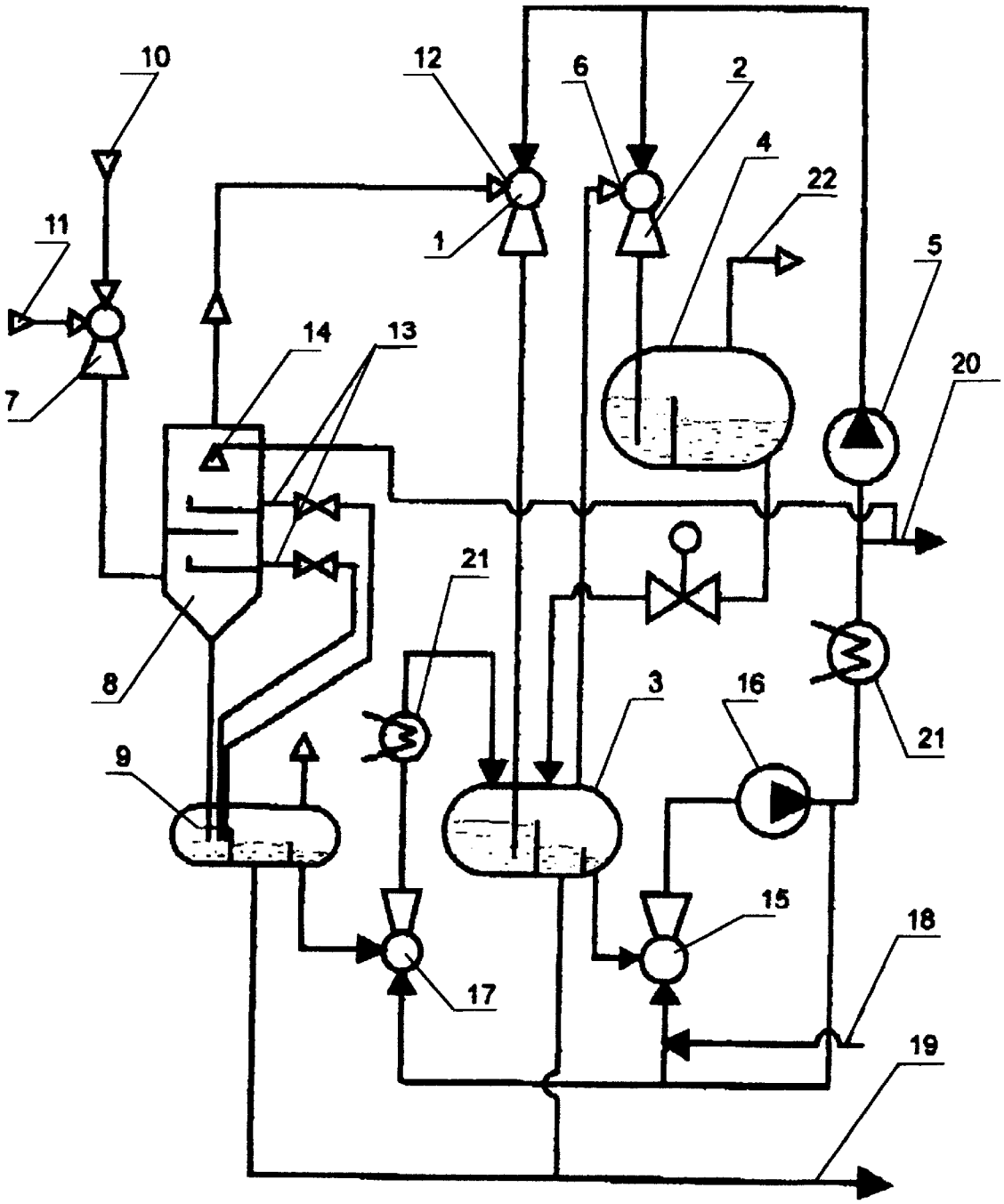
FIG. 1 represents a schematic diagram of the described pumping-ejection apparatus implementing the introduced operational method.

The pumping-ejection apparatus comprises first-stage and second-stage liquid-gas ejectors 1 and 2, first-stage and second-stage separators 3 and 4, and a pump 5. The suction side of the pump 5 is connected to the first-stage separator 3, the discharge side of the pump 5 is connected to the liquid inlets of the first-stage and second-stage ejectors 1 and 2, outlets of the ejectors 1, 2 are connected to the first-stage and second-stage separators 3, 4, respectively, the second-stage separator 4 is connected to the first-stage separator 3, the gas inlet 6 of the second-stage liquid-gas ejector 2 is connected to the first-stage separator 3. The apparatus is furnished with a steam-gas ejector 7, a counter-flow barometric condenser-separator 8 and an inlet separator 9. A nozzle of the steam-gas ejector 7 is connected to a source of compressed steam 10, the gas inlet of the steam-gas ejector 7 is connected to a source of an evacuated gaseous medium 11, an outlet of the steam-gas ejector 7 is connected to the counter-flow condenser-separator 8. The condenser-separator 8 is connected to the gas inlet 12 of the first-stage ejector 1 and to the inlet separator 9. The condenser-separator 8 is furnished with water discharge conduit(s) 13 and a device 14 for feeding a hydrocarbon condensing liquid, whose saturated vapor pressure is lower than the saturated vapor pressure of water. The inlet separator 9 is connected to the first-stage separator 3.

The apparatus can be furnished with a jet pump 15 and an additional pump 16 both installed between the first-stage separator 3 and the pump 5. An evacuated medium inlet of the jet pump 15 is connected to the first-stage separator 3, a nozzle of the jet pump 15 is connected to the discharge side of the additional pump 16, and an outlet of the jet pump 15 is connected to the suction side of the additional pump 16. The discharge side of the additional pump 16 is connected also to the suction side of the pump 5. Further, the apparatus can be furnished with an additional jet pump 17 installed between the inlet separator 9 and first-stage separator 3, a make-up supply conduit 18 and a water discharge line 19. The conduit 18 is connected to the nozzle of the jet pump 15, the line 19 is connected to the inlet separator 9 and first-stage separator 3, a nozzle of the additional jet pump 17 is connected to the discharge side of the additional pump 16, an evacuated medium inlet of the additional jet pump 17 is connected to the inlet separator 9 and an outlet of the additional jet pump 17 is connected to the first-stage separator 3. In addition, the apparatus can be equipped with a conduit 20 for discharging a surplus amount of a motive liquid, the device 14 for feeding the condensing hydrocarbon liquid into the condenser-separator 8 can be connected to the conduit 20.

Heat exchangers-coolers 21 can be included in the apparatus to provide cooling of the motive liquid, which is heated during operation. Compressed gas can be delivered from the second-stage separator 4 to consumers through a pipeline 22.

The pumping-ejection apparatus operates as follows.

Water steam under required pressure is delivered from the source 10 into the nozzle of the steam-gas ejector 7. Thus evacuation of a gaseous medium from the source 11 is effected. A steam-gas mixture formed in the ejector 7 is fed into the bottom section of the counter-flow barometric condenser-separator 8. Simultaneously a hydrocarbon condensing liquid, whose saturated vapor pressure is lower than the saturated vapor pressure of water, is fed into the upper section of the condenser 8. While flowing through the condenser 8 the condensing liquid condenses the steam and easy-condensable components of the evacuated gaseous medium. A portion of the steam condensate (water) is removed from the condenser 8 through the side conduits 13. The flow rate of the steam condensate through the conduits 13 can be adjusted if required. The rest of the steam condensate (water) and the condensed components of the evacuated gaseous medium form a mixture which passes from the condenser 8 to the inlet separator 9. Water from the conduits 13 can also be delivered into the inlet separator 9. Non-condensable gaseous components of the steam-gas mixture are evacuated from the condenser-separator 8 by the first-stage liquid-gas ejector 1. At the same time the mixture of condensates received from the condenser 8 is separated in the inlet separator 9 into water and the condensate of the condensable components of the evacuated gaseous medium. The water is discharged from the inlet separator 9 through the line 19. The condensate of the condensable components of the evacuated gas flows from the inlet separator 9 into the first-stage separator 3. The additional jet pump 17 can be used to provide transfer of the condensate from the inlet separator 9 to the first-stage separator 3. In this case a motive liquid is delivered into the nozzle of the jet pump 17 by the additional pump 16.

The motive liquid is fed by the pump 5 into the nozzles of the first-stage and second-stage liquid-gas ejectors 1 and 2. In the first-stage ejector 1 the non-condensable gaseous components of the steam-gas mixture evacuated from the condenser-separator 8, mix with the motive liquid and this mixture is fed into the first-stage separator 3. The mixture of mediums received from the inlet separator 9 and ejector 1 is separated in the first-stage separator 3 into a liquid phase and compressed gas. The compressed gas is evacuated from the first-stage separator 3 by the second-stage ejector 2. The liquid phase further is separated in the first-stage separator 3 into water and a mixture of the motive liquid and condensate of easy-condensable components of the evacuated gas (if the latter has appeared). The water is discharged from the first-stage separator 3 through the line 19. The motive liquid now constituting the mixture of the originally filled motive liquid and the condensate of easy-condensable components of the evacuated gaseous medium is delivered from the first-stage separator 3 to the suction port of the to pump 5. The jet pump 15 and the additional pump 16 can be used to provide delivery of the motive liquid from the first-stage separator 3 to the pump 5. Thus the additional pump 16 feeds the motive liquid into the nozzles of both jet pumps 15 and 17. The introduced layout of the apparatus provides an increased pressure of the motive liquid at the suction port of the pump 5 and at the same time allows maintaining and adjustment of pressures and flow rates of liquid mediums leaving the inlet and first-stage separators 9 and 3.

In the second-stage liquid-gas ejector 2 the compressed gas mixes with the motive liquid fed under pressure through the nozzle and undergoes additional compression. A mixture formed in the second stage ejector 2 moves further into the second-stage separator 4, where the additionally compressed gas is separated from the motive liquid. The motive liquid passes from the second-stage separator 4 through a regulator (if required) into the first-stage separator 3. The additionally compressed gas is delivered from the second-stage separator 4 to consumers through the pipeline 22. In case the apparatus is used for evacuation of hydrocarbon gases, a hydrocarbon liquid, gas oil for example, is employed usually as the motive liquid. The motive liquid can be fed into the condenser-separator 8 through the conduit 20 and device 14 as the condensing liquid. If make-up or refill of the motive liquid is necessary, fresh motive liquid is fed into the apparatus through the make-up supply conduit 18, which is connected for example to the nozzle of the jet pump 15 (although the point of connection can be different). Industrial Applicability: This invention can be applied in the chemical, petrochemical, food and some other industries, where evacuation and subsequent compression of gaseous mediums are required.

What is claimed is:

1. An operational method for a pumping-ejection apparatus, comprising:

evacuating a gas-vapor medium by a steam-gas ejector;

feeding a mixture of a steam and the evacuated gas-vapor medium formed in the steam-gas ejector into a condenser-separator;

simultaneously feeding a condensing hydrocarbon liquid having a saturated vapor pressure which is lower than the saturated vapor pressure of water, into the condenser-separator;

condensing a steam and at least a portion of the evacuated gas-vapor medium by the condensing hydrocarbon liquid flowing through the condenser-separator;

discharging a portion of a steam condensate from the condenser-separator;

delivering a mixture having the remainder of the steam condensate and a condensate of the at least the portion of the evacuated gas-vapor medium from the condenser-separator to an inlet separator;

separating the mixture delivered to the inlet separator into a volume of water and the condensate of the at least the portion of the evacuated gas-vapor medium;

discharging the volume of water from the inlet separator;

delivering a mixture of the condensate of the at least the portion of the evacuated gas-vapor medium and any residuary water from the inlet separator to a first-stage separator;

feeding a motive liquid under pressure into a first-stage liquid-gas ejector and a second-stage liquid-gas ejector by a pump;

evacuating a non-condensing gaseous component of the evacuated gas-vapor medium from the condenser-separator by the first-stage ejector;

discharging a gas-liquid mixture composed of the non-condensing gaseous components of the evacuated gas-vapor medium and the motive liquid from the first-stage ejector into the first-stage separator;

separating the mixtures received in the first-stage separator from the inlet separator and the first-stage ejector into a compressed gas, a volume of residuary water and a liquid mixture of the motive liquid and a condensate of the at least the portion of the evacuated gas-vapor medium;

discharging the volume of residuary water from the first-stage separator;

feeding the liquid mixture from the first-stage separator into the first-stage ejector and the second-stage ejector by the pump as the motive liquid;

evacuating the compressed gas from the first-stage separator by the second-stage ejector;

additionally compressing and mixing the compressed gas with the motive liquid in the second-stage ejector;

discharging a second gas-liquid mixture from the second-stage ejector into a second-stage separator;

separating the second gas-liquid mixture received from the second-stage ejector in the second-stage separator into an additionally compressed gas and the motive liquid;

delivering the additionally compressed gas from the second-stage separator to consumers; and delivering the motive liquid from the second-stage separator into the first-stage separator.

2. A pumping-ejection apparatus, comprising:

a steam-gas ejector, a counter-flow condenser-separator, an inlet separator, a first-stage ejector, a first-stage separator, a second-stage ejector, a second-stage separator and a pump, wherein:

a suction side of the pump is connected to the first-stage separator, a discharge side of the pump is connected to the first-stage ejector and the second-stage ejector, an outlet of each of the first-stage ejector and the second-stage ejector is connected to the first-stage separator and the second-stage separator, respectively, the second-stage separator is connected to the first-stage separator, a gas inlet of the second-stage ejector is connected to the first-stage separator, the steam-gas ejector is connected to a source of compressed steam and to a source of an evacuated gaseous medium, an outlet of the steam-gas ejector is connected to the counter-flow condenser-separator, the counter-flow condenser-separator is connected to a gas inlet of the first-stage ejector and to the inlet separator, the inlet separator is connected to the first-stage separator, and the counter-flow condenser-separator has a water discharge manifold and a device for feeding a hydrocarbon condensing liquid, wherein the hydrocarbon condensing liquid has a saturated vapor pressure which is lower than the saturated vapor pressure of water.

3. The pumping-ejection apparatus according to claim 2, further including a jet pump and an additional pump both installed between the first-stage separator and the suction side of the pump, wherein an evacuated medium inlet of the jet pump is connected to the first-stage separator, a nozzle of the jet pump is connected to a discharge side of the additional pump, an outlet of the jet pump is connected to a suction side of the additional pump, and the discharge side of the additional pump is connected to the suction side of the pump.

4. The pumping-ejection apparatus according to claim 2, further including a make-up supply conduit, a water discharge line and an additional jet pump installed between the inlet separator and the first-stage separator, wherein the make-up supply conduit is connected to a nozzle of the additional jet pump, the water discharge line is connected to the inlet separator and to the first-stage separator, a nozzle of the additional jet pump is connected to a discharge side of an additional pump, an evacuated medium inlet of the additional jet pump is connected to the inlet separator, and an outlet of the additional jet pump is connected to the first-stage separator.

5. The pumping-ejection apparatus according to claim 2, further including a conduit for discharging a surplus amount of a motive liquid, wherein the conduit for discharging the surplus amount of the motive liquid is connected to the device for feeding the hydrocarbon condensing liquid into the counter-flow condenser-separator.

* * * * *